United States Patent [19]

Shimomura et al.

[11] Patent Number: 4,883,035

[45] Date of Patent: Nov. 28, 1989

[54] METHOD AND DEVICE FOR CONTROLLING THE OPERATION OF AN ENGINE FOR A VEHICLE

[75] Inventors: Setsuhiro Shimomura; Yukinobu Nishimura, both of Himeji, Japan

[73] Assignee: Mitsubishi Denki Kabushiki Kaisha, Japan

[21] Appl. No.: 265,803

[22] PCT Filed: Feb. 10, 1988

[86] PCT No.: PCT/JP88/00133

§ 371 Date: Oct. 11, 1988

§ 102(e) Date: Oct. 11, 1988

[87] PCT Pub. No.: WO88/06235

PCT Pub. Date: Aug. 25, 1988

[30] Foreign Application Priority Data

Feb. 12, 1987 [JP] Japan ..... 62-30019

[51] Int. Cl.[4] ..... F02D 9/08; F02D 41/14

[52] U.S. Cl. ..... 123/361; 123/492

[58] Field of Search ..... 123/361, 399, 339, 352, 123/492; 364/426, 431.07

[56] References Cited

U.S. PATENT DOCUMENTS

| | | | |
|---|---|---|---|
| 4,594,987 | 6/1986 | Wataya et al. | 123/494 |
| 4,727,838 | 3/1988 | Oshiage et al. | 123/361 X |
| 4,729,104 | 3/1988 | Hara | 364/426 |
| 4,739,739 | 4/1988 | Wataya et al. | 123/479 |
| 4,763,264 | 8/1988 | Okuno et al. | 364/431.01 |
| 4,763,623 | 8/1988 | Sasaki | 123/339 |
| 4,765,295 | 8/1988 | Ishikawa | 123/361 |
| 4,768,483 | 9/1988 | Asayama | 123/399 |
| 4,781,162 | 11/1988 | Ishikawa et al. | 123/399 |
| 4,791,290 | 12/1988 | Ishikawa et al. | 123/361 X |
| 4,811,713 | 3/1989 | Shimada et al. | 123/399 |

FOREIGN PATENT DOCUMENTS

| | | |
|---|---|---|
| 49-8166 | 2/1974 | Japan . |
| 54-2449 | 2/1979 | Japan . |

*Primary Examiner*—Raymond A. Nelli

*Attorney, Agent, or Firm*—Leydig, Voit & Mayer

[57] ABSTRACT

An engine control method and device for a vehicle are disclosed in which jerk in the body of a vehicle developing upon acceleration or deceleration thereof can be always made substantially constant so as to improve riding comfort. Also, pitching or surging of the vehicle body during acceleration or deceleration thereof is substantially alleviated or suppressed even when the operator abruptly operates an accelerator pedal, thereby further improving riding comfort. To this end, a target degree of opening of a throttle valve is first set based on at least one of the sensed amount of accelerator pedal operation, the sensed engine load condition and the sensed number of revolutions per minute of the engine. The throttle valve operatively associated with the accelerator pedal is controlled in such a manner that, when the accelerator pedal is operated by the operator, the throttle valve is operated to move to the target degree of opening in synchronization with the intake stroke of the engine as sensed.

13 Claims, 4 Drawing Sheets

METHOD AND DEVICE FOR CONTROLLING THE OPERATION OF AN ENGINE FOR A VEHICLE

TECHNICAL FIELD

The present invention relates to a method and a device for controlling the operation of an engine mounted on a vehicle, and more particularly to an engine control method and device in which the power output of an engine particularly during acceleration or deceleration thereof is optimized so as to suppress pitching or surging of the vehicle for improved riding comfort.

BACKGROUND ART

In the past, there has been known a conventional engine control device employing a throttle actuator which is adapted to operate a throttle valve through an electrical signal for controlling the amount of intake air sucked into a vehicular engine. Specifically, the pressure of intake air sucked into the engine is sensed by a pressure sensor, and the width of pulses for driving a fuel injector disposed in an intake passage or manifold is controlled in accordance with the pressure value thus sensed so that the injector is driven every one or two engine revolutions in synchronization with the output signal of an engine rotation sensor which picks up the number of revolutions per minute of the engine. In this manner, the pulse width for the fuel injector is determined to match with the intake air pressure so that a desired amount of fuel is supplied to the engine. Such a control on fuel supply to the engine has been widely used as a speed-density type control and hence a further detailed description thereof will be unnecessary.

On the other hand, the amount of intake air sucked into the engine is controlled by a throttle valve which is disposed in the intake passage and which is in general mechanically opened and closed by an operator through a cable connected between the throttle valve and an accelerator pedal. Recently, however, it was proposed in Japanese Patent Application Laid-Open No. 61-126346 that, instead of directly connecting a throttle valve with an accelerator pedal through a cable, the throttle valve is electrically actuated by an electric actuator, and a portion of such an engine control device has been reduced into practice.

The conventional engine control device described above operates as shown in the flow chart of FIG. 1. Specifically, in Step 10, the output of the accelerator pedal sensor representative of the amount of operation $\alpha$ of an accelerator pedal imparted by the operator is read out, and in Step 11, the number Ne of revolutions per minute of the engine (hereinafter abbreviated as RPM) sensed by the engine rotation sensor and the pressure Pb of intake air are read out. Then, in Step 12, a target degree $\theta$ of opening of the throttle valve is calculated based on at least one of $\alpha$, Ne and Pb thus read out. In general, the target degree $\theta$ of throttle opening corresponds basically to the amount of accelerator pedal operation $\alpha$ and is modified or corrected, as necessary, by engine RPM Ne and intake air pressure Pb. For example, in a range in which the engine RPM Ne is low, the rate of change in the amount of intake air changes greatly with slight changes in the throttle opening degree and hence it is rather difficult for the operator to precisely control the amount of intake air to be sucked into the engine by adjusting the amount of operation (depression or return) of the accelerator pedal. To cope with this, it is proposed that in the low RPM range, the rate of change in the opening degree of the throttle valve be made smaller with respect to changes in the amount of accelerator pedal operation $\alpha$. On the other hand, it has also been considered that a target value of engine RPM Ne or vehicle speed be set at the operation amount $\alpha$ of the accelerator pedal so that the actual throttle opening is controlled in a feedback manner based on the differential between the target value and the sensed value of engine RPM Ne or vehicle speed. Further, since the intake pressure Pb is a physical quantity which corresponds to the output torque of the engine, it is possible to improve driving feel by properly adjusting the throttle opening based on the differential between a sensed actual value of intake pressure and a target value thereof which is preset at the operation amount $\alpha$ of the accelerator pedal. Accordingly, in Step 13, the throttle actuator is driven by an instruction of the control unit to control the throttle valve in such a manner that the actual throttle opening is changed to the target value $\theta$. In this case, the throttle actuator may be a pulse-driven open-loop control type actuator such as a stepping motor or a position-feedback control type actuator such as a DC motor.

With the above-described conventional engine control device, when the operation amount of the accelerator pedal increases swiftly, the torque output of the engine increases sharply so that jerk (change in rate of acceleration or deceleration) of the vehicle on which such an engine is installed becomes greater. Accordingly, the vehicle can have excellent acceleration performance on the one hand but riding comfort thereof is impaired on the other hand. This is because reactive force, which develops upon rapid acceleration or deceleration of the vehicle and is transmitted through the engine mounts to the vehicle body due to the general construction of the vehicle, causes the vehicle body to vibrate and at the same time pitching or surging thereof will be induced through the suspension system of the vehicle. In particular, the greater the jerk of the vehicle, the greater discomfort or uneasiness the driver feels.

Furthermore, a rise in the amount of intake air sucked into an engine immediately after acceleration of a vehicle varies depending on the timing of the acceleration, i.e., there is a great difference in the rising rate of the intake air amount depending on whether acceleration is carried out in an early period of an intake stroke or in a late period thereof, as clearly shown in FIG. 2 by the solid line and broken line, respectively. As a result, the magnitude of a jerk of the vehicle developing upon acceleration thereof also varies so that it is difficult to take appropriate measures which effectively suppress jerks of varying magnitude. In addition, when the engine is accelerated or decelerated by opening or closing the throttle valve, the air/fuel ratio varies due to time lags in the fuel control system. To overcome this, various measures are taken to correct or modify the air/fuel ratio and/or ignition timing, but such measures do not provide a uniform effect because of unavoidable variations in the amount of intake air occurring immediately after engine acceleration.

DISCLOSURE OF THE INVENTION

The present invention is intended to obviate the above-mentioned problems of the prior art.

An object of the present invention is to provide an engine control method and device for a vehicle in which jerk in the body of a vehicle developing upon acceleration or deceleration thereof can be always made substantially constant so as to improve riding comfort.

Another object of the present invention is to provide an engine control method and device for a vehicle in which pitching or surging of the body of a vehicle during acceleration or deceleration thereof is substantially alleviated or suppressed even when the operator abruptly operates an accelerator pedal, thereby further improving riding comfort.

In order to achieve the above objects, according to one aspect of the present invention, there is provided an engine control method for a vehicle in which a throttle valve in an engine intake passage is operatively associated with an accelerator pedal such that the opening degree of the throttle valve is changed by operation of the accelerator pedal so as to control the amount of intake air sucked into an engine, the method comprising:

sensing the amount of operation of the accelerator pedal imparted by an operator;

sensing the load condition of the engine;

sensing the number of revolutions per minute of the engine;

setting a target degree of opening of the throttle valve based on at least one of the sensed amount of accelerator pedal operation, the sensed engine load condition and the sensed number of revolutions per minute of the engine;

sensing intake strokes of the engine; and controlling the throttle valve in such a manner that, when the accelerator pedal is operated by the operator, the throttle valve is operated to move to the target degree of opening in synchronization with the intake stroke of the engine as sensed.

According to another aspect of the invention, there is provided an engine control device for a vehicle in which a throttle valve in an engine intake passage is operatively associated with an accelerator pedal such that the opening degree of the throttle valve is changed by operation of the accelerator pedal so as to control the amount of intake air sucked into an engine, the device comprising:

an accelerator pedal sensor for sensing the amount of operation of the accelerator pedal imparted by an operator;

a load sensor for sensing the load condition of the engine;

an engine rotation sensor for sensing the number of revolutions per minute of the engine as well as sensing intake strokes of the engine;

a throttle actuator operatively connected with the throttle valve for operating the throttle valve so as to adjust the opening degree thereof; and a control unit connected to receive the output signals from the sensors for controlling the operation of the throttle actuator, the control unit being operable to set a target degree of opening of the throttle valve based on at least one of the sensed amount of accelerator pedal operation, the sensed engine load condition and the sensed number of revolutions per minute of the engine, and control the throttle actuator in such a manner that, when the accelerator pedal is operated by the operator, the throttle valve is operated to move to the target degree of opening in synchronization with the intake stroke of the engine as sensed.

The above and other objects, features and advantages of the present invention will become apparent from the following detailed description of a presently preferred embodiment thereof when taken in conjunction with the accompanying drawings.

BEST MODE FOR CARRYING OUT THE INVENTION

Figure 3:
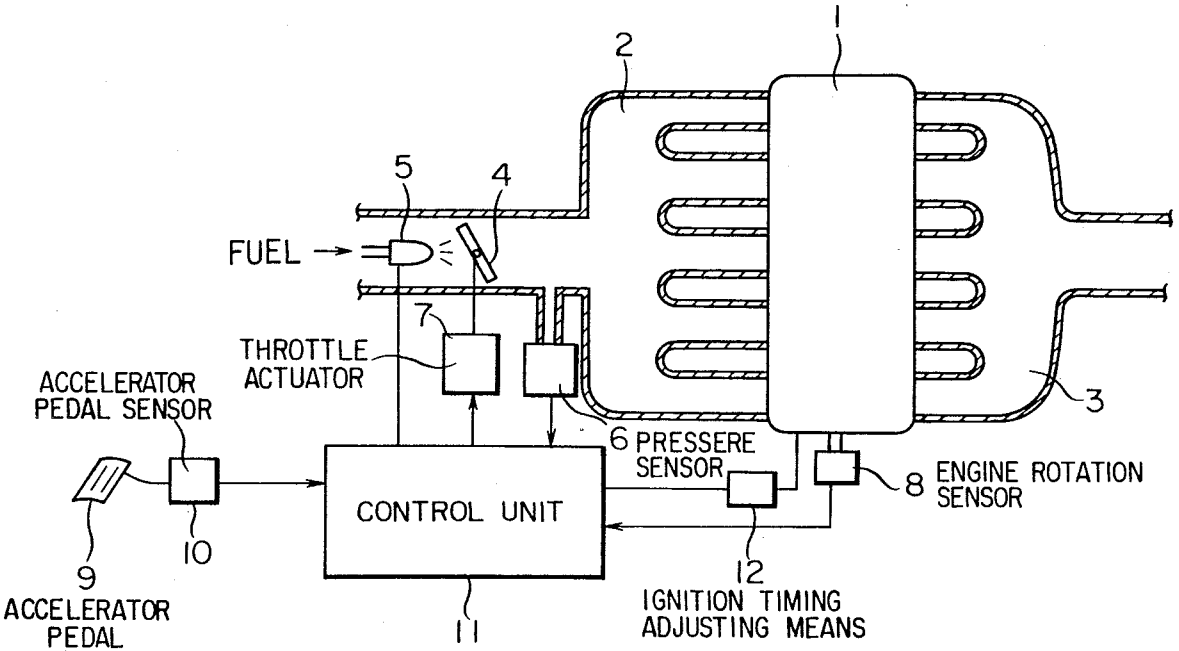
FIG. 3 is a schematic view showing the general arrangement of an engine control device for a vehicle in accordance with the present invention.

The present invention will now be described in detail with reference to a presently preferred embodiment thereof as illustrated in the accompanying drawings Referring first to FIG. 3, there is shown the general arrangement of an engine control device for a vehicle in accordance with the present invention. The engine control device as illustrated comprises an engine proper 1, an intake passage or manifold 2 connected with the engine proper 1 for supplying an air/fuel mixture to the engine proper 1, an exhaust passage or manifold 3 connected with the engine proper 1 for discharging exhaust gas from the engine proper 1 to the ambient atmosphere, a throttle valve 4 disposed in the intake manifold 2 for controlling the amount of intake air or mixture sucked into the engine proper 1, a fuel supply means 5 in the form of an injector disposed in the intake manifold 2 for injecting fuel fed from an unillustrated fuel source into the intake manifold 2, a load sensor 6 in the form of a pressure sensor for sensing the pressure in the intake manifold 2 representative of an engine load, a throttle actuator 7 operatively connected with the throttle valve 4 for adjusting the opening degree thereof, and an engine rotation sensor 8 sensing the number Ne of revolutions per minute of the engine as well as sensing intake strokes of the engine, i.e., whether or not the engine is at a predetermined point of each intake stroke. In order to sense engine intake strokes, the engine rotation sensor 8 senses, for example, the crank angle of the engine and generates a crank angle signal whenever the engine takes a predetermined crank angle, i.e., whenever the engine reaches top dead center in each intake stroke. The engine control device further comprises an accelerator pedal 9 adapted to be operated by an operator for adjusting the opening degree of the throttle valve 4 via the throttle actuator 7, an accelerator pedal sensor 10 for sensing the amount of operation of the accelerator pedal 9 imparted by the operator, an ignition timing adjusting means 12 for adjusting ignition timing of the engine, and a control unit 11 which is inputted with the respective output signals from the accelerator pedal sensor 10, the pressure sensor 6 and the engine rotation sensor 8 for controlling the operations of the fuel injector 5, the throttle actuator 7 and the ignition timing control means 12. The control unit 11 comprises a microprocessor, a random access memory, a read only memory and the like, and acts to carry out calculations based on the various input signals from the sensors in accordance with prescribed procedures or programs stored in the read only memory so as to control the fuel injector 5, the throttle actuator 7 and the like. Thus, for example, the control unit 11 calculates a target degree of opening of the throttle valve 4 based on at least one of the sensed amount of accelerator pedal operation, the sensed engine load condition and the sensed number of revolutions per minute of the engine.

Figure 1:
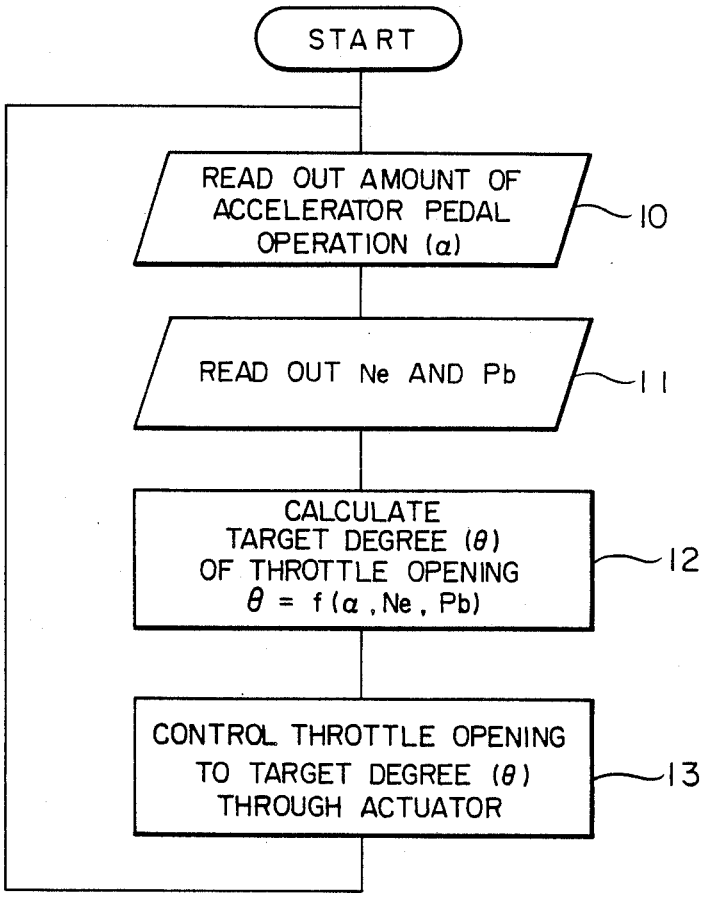
FIG. 1 PRIOR ART
FIG. 1 is a flow chart showing the operating process of a conventional engine control device for a vehicle according to a conventional engine control method.
Figure 2:
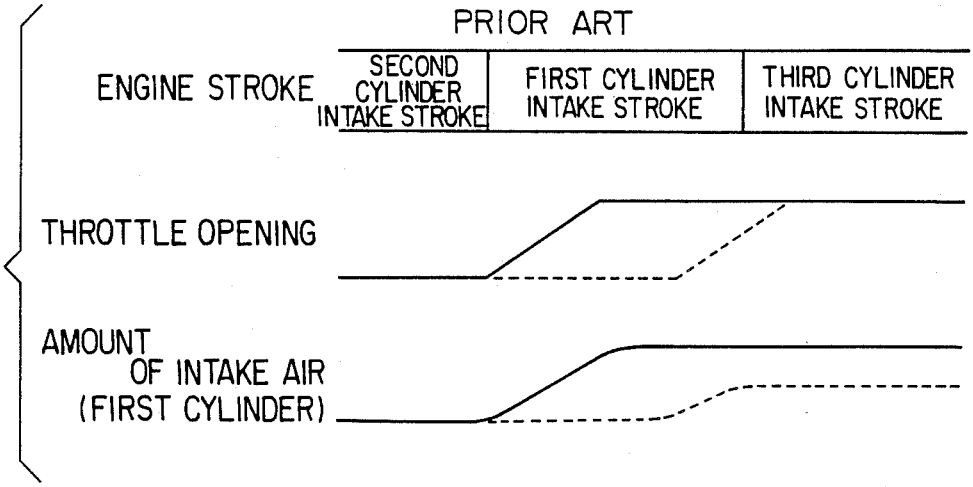
FIG. 2 PRIOR ART
FIG. 2 is a timing chart showing the relationship between the opening degree of a throttle valve and the amount of intake air sucked into an engine with respect to engine strokes according to the conventional engine control method.
Figure 4:
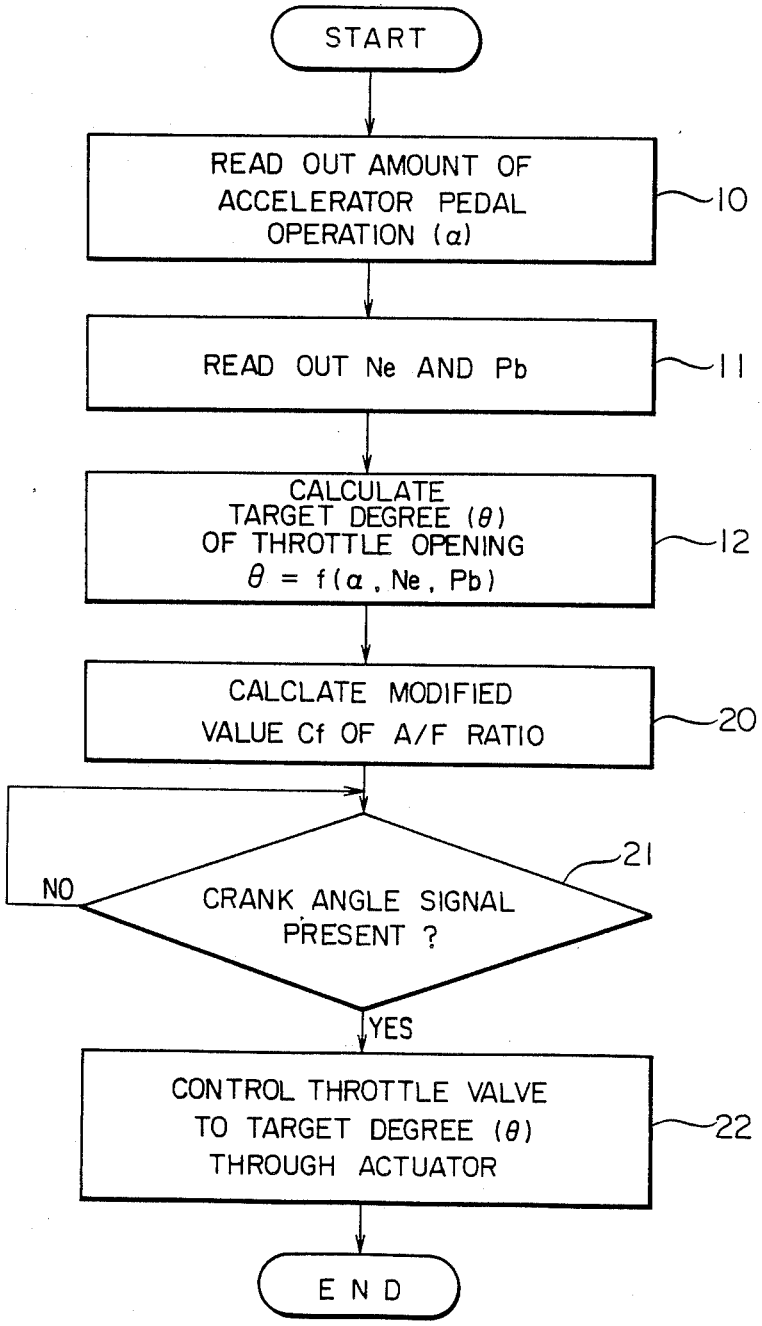
FIG. 4 is a flow chart showing the operating process of the engine control device in accordance with the present invention.

Description will now be made of the operation of the above-described engine control device of the invention with particular reference to FIGS. 4 and 5. Referring first to FIG. 4, Steps 10 through 12 are the same as those in FIG. 1. In Step 20, the control unit 11 calculates a modified or corrected value Cf of the air/fuel ratio which is required to optimize engine operation when the actual opening degree of the throttle valve 4 is changed to a target opening degree $\theta$ which is determined in Step 12 in the same manner as in FIG. 1. In Step 21, it is determined whether or not the engine is at the predetermined point of each intake stroke, i.e., whether or not there is a crank angle signal input from the engine rotation sensor 8 to the control unit 11, and if it is "NO", Step 21 is repeated until a crank angle signal is input to the control unit 11. On the other hand, if it is "YES", the control process proceeds to Step 22 wherein the control unit 11 controls the throttle actuator 7 in such a manner that the throttle valve 4 is moved to take the target opening degree $\theta$. Also, in Step 22, simultaneous to such movement of the throttle valve 4, the control unit 11 controls the fuel supply means or fuel injector 5 such that the air/fuel ratio of the mixture is optimized based on the modified value of air/fuel ratio which is calculated in Step 20. Then, the entire control process ends.

In this connection, it is preferable to control the throttle actuator 7 in such a manner that the throttle valve 4 is gradually moved to the target opening degree $\theta$ in accordance with a delay function $f_d$ so as to minimize jerk in the vehicle and/or produce a desired jerk of a limited magnitude. An example of such a delay function is $$f_d = (1 - \epsilon^{-\frac{t}{\tau}}),$$

where t=time and $\tau$=a first-order delay time constant which is set to be an optimal value based on the engine characteristics, suspension characteristics and the like of a specific type of vehicle. For example, such a time constant is generally set to be 0.1–0.5 seconds. Using such a delay function, the opening degree $\theta_1$ of the throttle valve 4 is progressively changed in accordance with the following formula:

$$\theta_1 = (1 - \epsilon^{-\frac{t}{\tau}}) \times f(\alpha, Ne, Pb).$$

Figure 5:
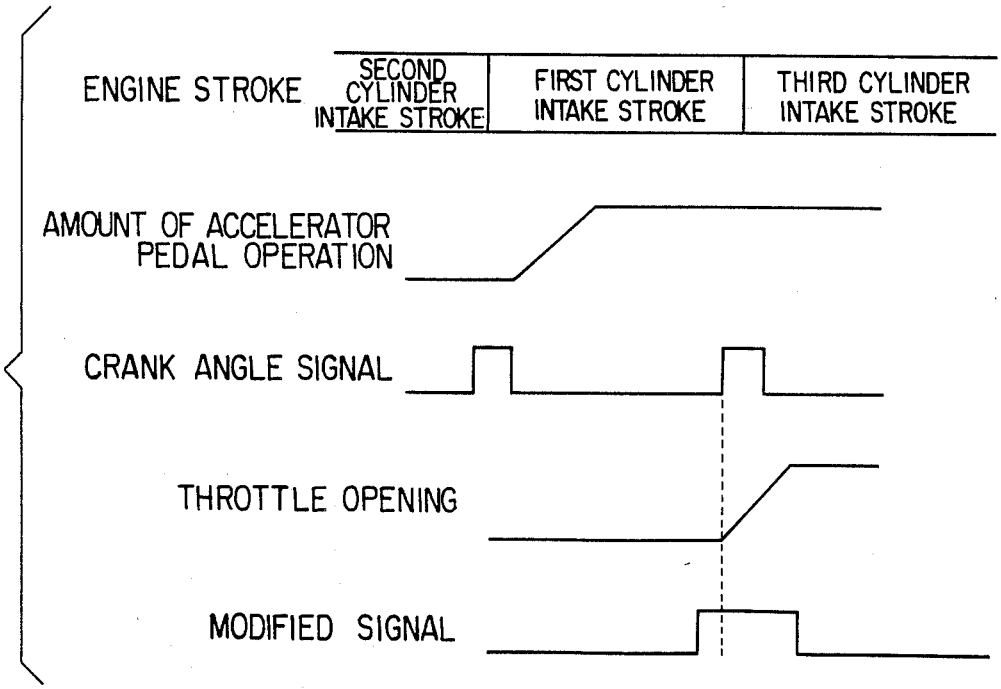
FIG. 5 is a timing chart showing the relations between various factors controlled by the engine control device of the present invention with respect to engine strokes.

In this manner, the control unit 11 is able to control the throttle actuator 7 such that the opening degree of the throttle valve 4 is always increased or decreased by the throttle actuator 7 in synchronization with intake strokes of the engine, i.e., at top dead center of an intake stroke as clearly shown in FIG. 5. As a result, the amount of intake air sucked into the engine proper 1 can be made substantially constant even at transitional time such as acceleration or deceleration of the vehicle.

Although in the above description, Steps 21 and 22 are included in the main routine of the control process or program illustrated in FIG. 4 for the sake of simplification of explanation, it is possible to execute Step 22 through an interruption routine only when a crank angle signal is input to the control unit 11 in order to prevent fluctuations in delay time of reading the crank angle signal due to the calculation period of the main routine. In this manner, Step 22 is always executed in a substantially constant angular relationship with respect to engine crank angle, thereby further improving engine control. Furthermore in the above description, a crank angle signal is issued at top dead center of an intake stroke by the engine rotation sensor 8, but it may of course be issued at another crank angle with the same effects.

Moreover, though not illustrated in FIG. 4, it is well known in the art to modify or correct ignition timing of an engine at transitional time such as acceleration or deceleration of a vehicle. Thus, in Step 20 in FIG. 4, the control unit 11 may calculate a modified or corrected value of ignition timing and control the ignition timing adjusting means 12 so that ignition timing of the engine is modified or corrected with the value thus calculated so as to provide further improved engine control.

As described above, the present invention provides a novel engine control method and device for controlling the operation of a vehicular engine, in which a target opening degree of a throttle valve is determined based on at least one of such parameters as accelerator pedal operation, engine load condition, engine RPMs and the like, and the throttle valve is moved to the target opening degree in synchronization with intake strokes of the engine. Accordingly, the amount of intake air sucked into the engine upon acceleration and deceleration of the vehicle is effectively prevented from fluctuations so that the jerk of the vehicle can always be made substantially constant or uniform and thus adjusted to be of a desirable limited value, thereby markedly improving riding comfort. Moreover, a change in the air/fuel ratio developing upon a change in the amount of intake air sucked into the engine is prevented from fluctuation and made substantially uniform so that an appropriately modified or corrected value of the air/fuel ratio and/or ignition timing can be precisely predetermined so as to substantially suppress or reduce the jerky motion of the vehicle. In addition, the method and device of the present invention can be readily reduced into practice at low cost by merely replacing a conventional control program stored in the control unit with a new one of the invention.

We claim:

1. An engine control method for a vehicle in which a throttle valve in an engine intake passage is operatively associated with an accelerator pedal such that the opening degree of said throttle valve is changed by operation of said accelerator pedal so as to control the amount of intake air sucked into an engine, said method comprising:

sensing the amount of operation of said accelerator pedal imparted by an operator;

sensing the load condition of said engine;

sensing the number of revolutions per minute of said engine;

setting a target degree of opening of said throttle valve based on at least one of the sensed amount of accelerator pedal operation, the sensed engine load condition and the sensed number of revolutions per minute of said engine;

sensing intake strokes of said engine; and controlling said throttle valve in such a manner that, when said accelerator pedal is operated by the operator, said throttle valve is operated to move to the target degree of opening in synchronization with the intake stroke of said engine as sensed.

2. An engine control method for a vehicle as claimed in claim 1, wherein said step of sensing intake stroke of said engine comprises sensing the crank angle of said engine so that said throttle valve is started to operate at a predetermined crank angle as sensed.

3. An engine control method for a vehicle as claimed in claim 2, wherein said throttle valve is started to operate at the top dead center of an intake stroke of said engine.

4. An engine control method for a vehicle as claimed in claim 1, wherein when said accelerator pedal is abruptly operated by the operator, said throttle valve is gradually moved to be at the target degree of opening.

5. An engine control method for a vehicle as claimed in claim 1, further comprising:

calculating a modified value of air/fuel ratio required when the actual opening degree of said throttle valve is changed to the target opening degree; and optimizing the air/fuel ratio of the mixture based on said modified value of air/fuel ratio upon operation of said throttle valve.

6. An engine control method for a vehicle as claimed in claim 1, further comprising:

calculating a modified value of ignition timing required when the actual opening degree of said throttle valve is changed to the target opening degree; and optimizing the ignition timing of said engine based on the modified value of ignition timing upon operation of said throttle valve.

7. An engine control device for a vehicle in which a throttle valve in an engine intake passage is operatively associated with an accelerator pedal such that the opening degree of said throttle valve is changed by operation of said accelerator pedal so as to control the amount of intake air sucked into an engine, said device comprising:

an accelerator pedal sensor for sensing the amount of operation of said accelerator pedal imparted by an operator;

a load sensor for sensing the load condition of said engine;

an engine rotation sensor for sensing the number of revolutions per minute of said engine as well as sensing intake strokes of said engine;

a throttle actuator operatively connected with said throttle valve for operating said throttle valve so as to adjust the opening degree thereof; and a control unit connected to receive the output signals from said sensors for controlling the operation of said throttle actuator, said control unit being operable to set a target degree of opening of said valve based on at least one of the sensed amount of pedal operation, the sensed engine load condition and the sensed number of revolutions per minute of said engine, and control said throttle actuator in such a manner when said accelerator pedal is operated by the operator said throttle valve is operated to move to the target degree of opening in synchronization with the intake stroke of said engine as sensed.

8. An engine control device for a vehicle as claimed in claim 7, in which said engine rotation sensor senses the crank angle of said engine, said control unit being operable to control said throttle actuator in such a manner that said throttle valve is started to operate when said engine rotation sensor senses that said engine takes a predetermined crank angle.

9. An engine control device for a vehicle as claimed in claim 8, wherein said control unit controls said throttle actuator in such a manner that said throttle valve is started to operate at top dead center of an intake stroke of said engine

10. An engine control device for a vehicle as claimed in claim 7, wherein said control unit controls said throttle actuator in such a manner that, when said accelerator pedal is abruptly operated by the operator, said throttle valve is gradually moved to be at the target degree of opening.

11. An engine control device for a-vehicle as claimed in claim 7, further comprising a fuel supply means associated with said control unit for supplying fuel to said engine, wherein said control unit is operable to calculate a modified value of air/fuel ratio required for changing the actual opening degree of said throttle valve to the target opening degree, and control said fuel supply means so that the air/fuel ratio of the mixture is optimized based on said modified value of air/fuel ratio upon operation of said throttle valve.

12. An engine control device for a vehicle as claimed in claim 11, wherein said fuel supply means comprises a fuel injector.

13. An engine control device for a vehicle as claimed in claim 7, further comprising an ignition timing adjusting means associated with said control unit for adjusting ignition timing of said engine, wherein said control unit is operable to calculate a modified value of ignition timing required when the actual opening degree of said throttle valve is changed to the target opening degree, and control the ignition timing adjusting means so that the ignition timing of said engine is optimized based on the modified value of ignition timing upon operation of said throttle valve.

* * * * *